US010072460B2

(12) United States Patent
Cavarec et al.

(10) Patent No.: US 10,072,460 B2
(45) Date of Patent: Sep. 11, 2018

(54) MOTORIZED INSTALLATION FOR MANEUVERING A SCREEN AND ASSOCIATED SCREEN DEVICE

(71) Applicant: Somfy SAS, Cluses (FR)

(72) Inventors: Pierre-Emmanuel Cavarec, Mont Saxonnex (FR); Sebastien Lemaitre, Cluses (FR)

(73) Assignee: Somfy SAS, Cluses (FR)

( * ) Notice: Subject to any disclaimer, the term of this patent is extended or adjusted under 35 U.S.C. 154(b) by 138 days.

(21) Appl. No.: 15/028,672

(22) PCT Filed: Oct. 13, 2014

(86) PCT No.: PCT/EP2014/071832
§ 371 (c)(1),
(2) Date: Apr. 11, 2016

(87) PCT Pub. No.: WO2015/052341
PCT Pub. Date: Apr. 16, 2015

(65) Prior Publication Data

US 2016/0258213 A1 Sep. 8, 2016

(30) Foreign Application Priority Data

Oct. 11, 2013 (FR) ..... 13 59917

(51) Int. Cl.
*E06B 9/68* (2006.01)
*E06B 9/322* (2006.01)
(Continued)

(52) U.S. Cl.
CPC ..... *E06B 9/68* (2013.01); *E06B 9/322* (2013.01); *E06B 9/64* (2013.01); *E06B 9/72* (2013.01)

(58) Field of Classification Search
CPC ..... E06B 9/40; E06B 9/64; E06B 9/68; E06B 9/70; E06B 9/72; E06B 9/322; E06B 2009/3222
(Continued)

(56) References Cited

U.S. PATENT DOCUMENTS 5,372,173 A * 12/1994 Horner ..... E06B 9/40 160/310
5,630,460 A * 5/1997 Yuan ..... B60H 1/00592 160/120
(Continued)

FOREIGN PATENT DOCUMENTS

WO WO 2012/085252 A 6/2012

OTHER PUBLICATIONS

International Search Report and Written Opinion prepared by European Patent Office as International Searching Authority for International Application PCT/EP2014/071832 dated Dec. 16, 2014.
(Continued)

*Primary Examiner* — Robert Canfield
(74) *Attorney, Agent, or Firm* — Haug Partners LLP

(57) ABSTRACT

The invention relates to a screen device (10) comprising a screen (16) movable between a retracted position and a deployed position, bearing on a load bar (12), and motorized by an installation comprising at least two winding units (24), each comprising a winding coil (26) associated with a driving gear motor (28), the winding coils (26) being guided to rotate relative to the box (18) mechanically independently from one another. A control circuit (32) synchronizes the two winding units (24) by driving each gear motor (28) so as to ensure the horizontal position of the load bar. To that end, the control circuit (32) is connected to one or more sensors (34), for example accelerometers, delivering a signal representative of the levelness of the load bar.

19 Claims, 5 Drawing Sheets

(51) Int. Cl.
*E06B 9/64* (2006.01)
*E06B 9/72* (2006.01)

(58) Field of Classification Search
USPC ..... 160/168.1, 170, 171, 84.01, 310, 312
See application file for complete search history.

(56) References Cited

U.S. PATENT DOCUMENTS

| | | | | |
|---|---|---|---|---|
| 6,491,332 | B2 * | 12/2002 | De Ceuster | B60R 5/047 160/24 |
| 6,761,202 | B1 * | 7/2004 | Cheng | E06B 9/322 160/170 |
| 6,948,545 | B1 * | 9/2005 | Cheng | E06B 9/322 160/170 |
| 8,453,707 | B2 * | 6/2013 | Lambridis | E06B 9/70 160/188 |
| 9,335,753 | B2 * | 5/2016 | Baugh | G05B 19/042 |
| 2008/0314528 | A1 * | 12/2008 | Davis | E06B 9/36 160/84.02 |
| 2013/0068402 | A1 * | 3/2013 | Shun | E06B 9/322 160/170 |
| 2013/0233496 | A1 * | 9/2013 | Ogden, Jr. | E06B 9/322 160/84.02 |
| 2013/0269885 | A1 * | 10/2013 | Cavarec | E06B 9/64 160/311 |

OTHER PUBLICATIONS

Search Report prepared by French Patent Office for priority application FR 1359917 dated Jun. 3, 2014.

* cited by examiner

Fig.1
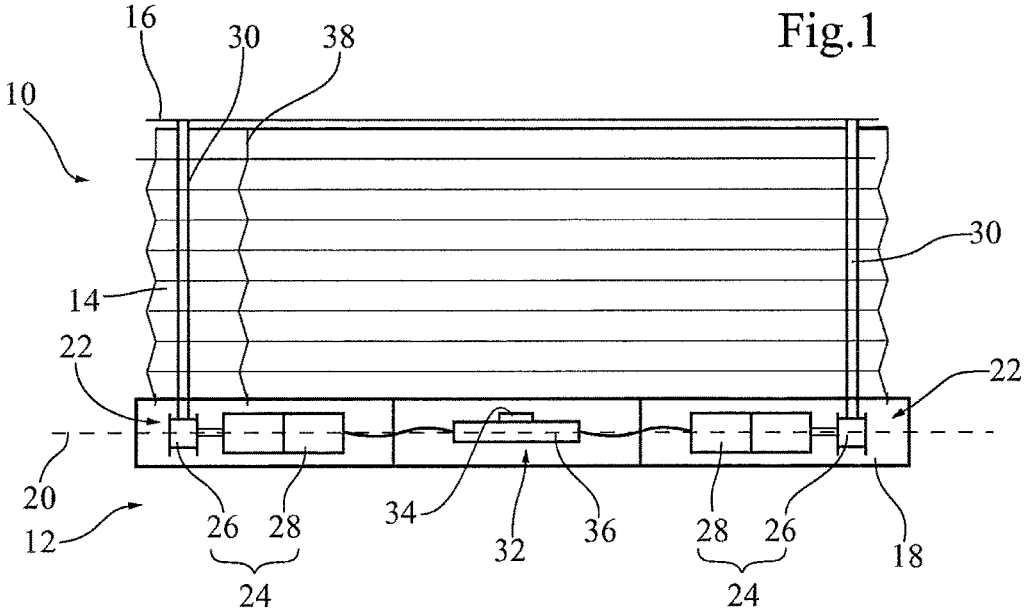
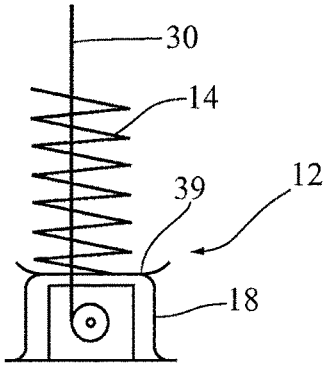
Fig.2
Fig.3
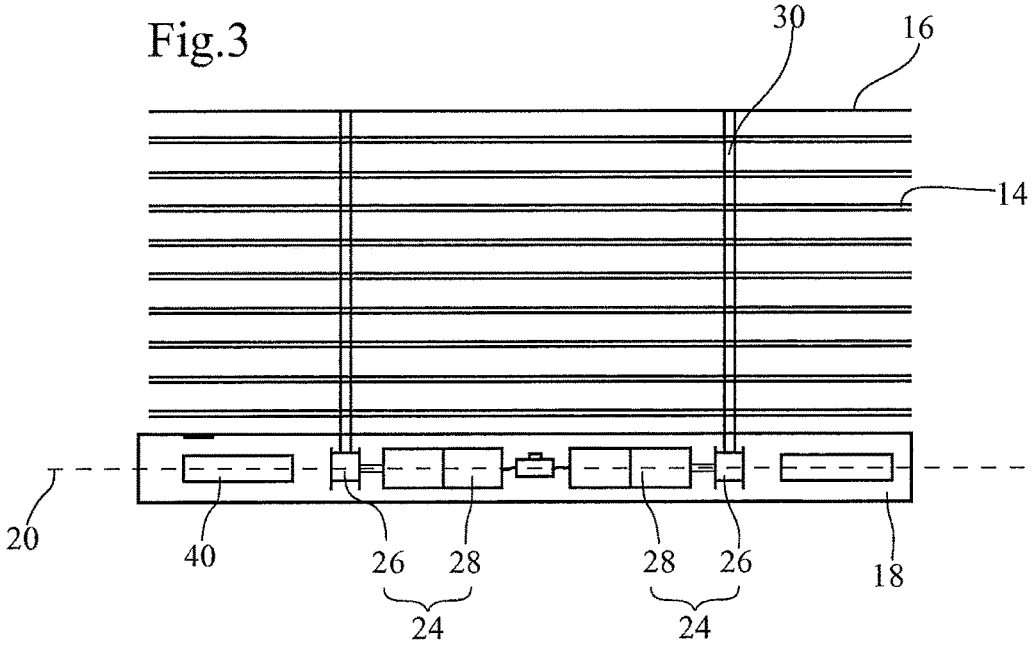

MOTORIZED INSTALLATION FOR MANEUVERING A SCREEN AND ASSOCIATED SCREEN DEVICE

CROSS-REFERENCE TO RELATED APPLICATIONS

This application is the National Stage entry under 35 U.S.C. § 371 of International Application No. PCT/EP2014/071832 filed on Oct. 13, 2014, published on Apr. 16, 2015 under publication number WO 2015/052341 A1, which claims the benefit of priority under 35 U.S.C. § 119 of French Patent Application Number 1359917 filed Oct. 11, 2013.

TECHNICAL FIELD OF THE INVENTION

The invention relates to a motorized installation for maneuvering a screen with vertical or oblique deployment, and notably a home automation screen with partial or total occultation of an opening in a building, a partition or projection screen, a solar protection screen with vertical or oblique deployment, or further an anti-intrusion grid or shutter. More specifically it relates to a motorized installation for an at least vertically mobile screen between a position that is retracted, stacked or wound on a load bar and a deployed position, and notably a cell screen, a screen with individual slats, with jointed slats like an accordion or with bellows, or a folded screen in a single flexible part, or a windable screen.

STATE OF THE PRIOR ART

For motorizing cell or folded screens, one usually resorts to a motor which may drive in parallel several coils on which will be wound cords from which is suspended a load bar or the end of the screen. The adjustment of the length of the cords is then tedious, and controlling the horizontality of the load bar or of the free end of the screen during the deployment poses problems. This problem is particularly critical when the width of the screen is large.

Moreover screen devices are known for which the load bar is also a bar for winding the screen. But the existing configurations do not give simply the possibility of adjusting the width of the screen to that of the opening to be equipped, and notably when the latter is large.

Therefore there exist needs for enhancing the motorization of cell, folded or windable screens, notably of large dimensions.

DISCUSSION OF THE INVENTION

The invention aims at finding a remedy to the drawbacks of the state of the art. To this end, according to a first aspect of the invention a motorized installation for maneuvering a screen having a first mobile end and a second opposite end is proposed, including at least two winding units positioned at the same first or second end of the screen, each of the two winding units including a winding drum associated with a driving gear motor, the winding drums being guided so as to rotate mechanically independently of each other and in that it further includes an electronic control circuit including means for synchronizing both winding units. By making both drums mechanically independent of each other in their rotary movement, it is possible to control each drum independently, and with, if necessary, a dynamic control of the horizontality of the load bar.

According to an embodiment, the control circuit controls each gear motor so as to ensure horizontality of a reference axis of the first mobile end of the screen. Provision may notably be made for connecting the control circuit to one or several sensors delivering a signal representative of the horizontality of the reference axis.

According to an embodiment, the reference axis coincides with an axis of rotation of at least one of the winding drums or of one of the gear motors. According to a first variant, the load bar extends over the whole length of the first end, and the synchronization means aim at ensuring the horizontality of this load bar.

According to another variant, there exist two more or less spaced apart independent load bars so as to cover all or part of the length of the first end, the synchronization means then being controlled so that both load bars are always at the same height, so as to avoid creasing on the screen or urging it in a non-symmetrical way.

According to an embodiment, the reference axis is a longitudinal axis of a load bar bound to the first mobile end of the screen or to a portion of the first mobile end of the screen. In practice, the control circuit or a part of the latter may be integrated to the load bar and include one or several accelerometers for example positioned on a printed circuit board of the control circuit. Provision may also be made so that the control circuit is able to detect the rotation of each gear motor.

Preferably, each winding drum is a winding coil for a flexible connection independent of the screen including a first end attached to the winding coil and a second end intended to be directly or indirectly attached to a dormant structure or to a load bar. The flexible connection may be formed by any type of rope, cord, wire, ribbon or tape able to be wound on a coil. In order to avoid having to handle the positioning of the successive turns during the winding, a flat flexible connection of the ribbon type will be preferred.

According to a preferred embodiment, the winding coils rotate around a same longitudinal reference axis. Alternatively, the winding coils each rotate around two parallel axes distant from each other.

According to a preferred embodiment, a box defines two housings for the gear motors of both winding units. The installation is thus an assembly unit. The thereby obtained structure is particularly simple. It will be of interest to integrate all or part of the electric control circuit to the structure, preferably inside the box or attached to the box.

It will be advantageous to provide positioning of both winding units at two longitudinal ends inside the box of the installation, which notably gives the possibility of positioning the gear motors after having cut out the box to the desired length, if necessary, directly on the installation site, after taking measurements on a dormant structure such as an opening frame in a building.

It is also possible to choose to position the gear motors in a more central way, for example if the width of the screen is large, or if it is desired to facilitate the access to power supply batteries of the gear motors, batteries which may then be placed at the ends of the box. Thus, according to an embodiment, at least one battery is positioned between one of the gear motors and a longitudinal end of the box, the closest to said gear motor.

According to an embodiment, the coils are positioned outside and in the longitudinal extension of the body, which gives the possibility of further simplifying the structure of the box, the assembling of the different elements and the holding of the assembly.

According to a preferred embodiment, the box is a body of a load bar of the screen. The installation itself then becomes a load bar. In order to avoid oscillations or undesirable behaviors, it is preferably provided that the load bar has a center of gravity located below the common reference axis of rotation of the coils.

According to a particularly advantageous embodiment, the load bar is a winding drum of the screen. Each gear motor, for which the stator and the case are secured to the box of the load bar, drives into rotation simultaneously and in the opposite direction the box of the load bar and the associated coil.

According to another particularly advantageous embodiment, each drum B is a drum for winding a portion of the screen. Both drums are then controlled by the synchronization means so as to remain aligned with each other. A control with a master drum and a slave drum may also notably be provided. It then becomes very simple to adapt on site the installation to the desired width in a particular application, by more or less separating both drums from each other. This solution has the additional advantage, as compared with a solution with a drum extending over the whole length of the screen, of limiting the mass at the mobile end of the screen. One should have in mind that the increase of the mass of a load bar is not proportional to the increase in length, since additional reinforcements have to be provided for great lengths, so as to preserve sufficient rigidity at the load bar. The proposed solution gives the possibility of providing two lateral drums with small lengths, not requiring specific stiffening reinforcements, while a single drum having the same total length would be necessarily more massive. In order to maximize these advantages, it is in particular possible to provide that a median portion of the screen is not wound on any of the winding drums.

For seamless operation, it is preferably provided that each winding unit is connected to a pendulum, preferably including a photovoltaic unit. According to a variant, both winding units are connected to a common pendulum preferably including a photovoltaic unit. In this case it is possible to integrate to the pendulum an accelerometer for detecting the horizontality of the pendulum.

According to another aspect of the invention, the latter relates to a screen device including a mobile screen between a retracted position and a deployed position, a load bar formed by a motorized maneuvering installation, the screen having a first end resting on an upper external face of the load bar and a second end intended to be directly or indirectly attached to a dormant structure, the motorized maneuvering installation including at least two winding units positioned at the first end of the screen, each of the two winding units including a winding drum associated with a driving gear motor, the winding drums being guided so as to rotate mechanically independently of each other, the motorized installation further including an electronic control circuit including means for synchronizing both winding units. Preferably, the winding coils rotate around a same longitudinal reference axis. The coils may be positioned on the outside and in the longitudinal extension of the load bar, or in intermediate positions. Each winding drum is a winding coil for a flexible connection independent of the screen, including a first end attached to the winding coil and a second end intended to be directly or indirectly attached to the dormant structure. The device is particularly adapted to a cell screen, a screen with individual slats, with articulated slats like an accordion or with bellows, or a screen folded into a single flexible part.

According to another aspect of the invention, the latter relates to a rolling screen device including a screen, a motorized load bar defining a reference axis and forming a drum for winding the screen around the reference axis, an end of the screen being attached to the load bar, the bar further including at least one, and preferably two winding units, each winding unit including a gear motor housed in the load bar, a coil on the outside of the load bar, and a flexible connection independent of the screen, wound around the coil, the coil being guided in rotation around the reference axis.

The winding of the screen on the load bar and on one or both coils are in a direction opposite to each other.

According to another aspect of the invention, the latter relates to a screen device including a mobile screen between a retracted position and a deployed position, and a box attached to a dormant structure, the box defining two housings for two gear motors of a motorized installation for maneuvering the screen including at least two winding units each including a winding drum associated with one of the two driving gear motors, the winding drums being guided so as to rotate mechanically independently of each other, the motorized installation further including an electronic control circuit including means for synchronizing both winding units. Each winding drum is a winding coil for a flexible connection independent of the screen, including a first end attached to the winding coil and a second end directly or indirectly attached to a mobile end of the screen or to a load bar. The device is particularly suitable for a cell screen, a screen with individual slats, with articulated slats like an accordion or with bellows, or a screen folded into one single flexible part.

According to another aspect of the invention, the latter relates to a rolling screen device including a screen intended to be directly or indirectly suspended by a fixed end from a dormant structure, the screen including a second mobile end, the device further including a motorized installation for maneuvering the screen, including at least two winding units positioned at the mobile end of the screen, each of the two winding units including a winding drum of one portion of the screen associated with a driving gear motor, the winding drums being guided so as to rotate mechanically independently of each other, the motorized installation further including an electronic control circuit including means for synchronizing both winding units. Both drums are positioned co-axially, at a distance from each other, so that, if necessary, a median portion of the screen, located between both drums, may be wound on itself without being wound on any of the winding drums. Each winding unit is preferably connected to a pendulum, preferably including a photovoltaic unit. The installation may include two independent pendulums or a common pendulum. In practice, the pendulum(s) is(are) connected to the output shafts of the driving gear motors.

According to another aspect of the invention, the latter relates to a rolling screen device including a screen having a mobile end of a given length, a motorized load bar defining a reference axis and forming a winding drum for the screen around the reference axis, the drum having a winding length of less than the given length of the mobile end, a first portion of the mobile end of the screen being attached to the load bar, a second portion of the mobile end extending as a cantilever beyond the load bar. The length of the cantilever portion may be freely selected depending on the opening to be fitted out. Thus, with a same drum, it is possible to vary the length of the mobile end of the screen. In practice, the cantilever portion will have a length of less than the length of the drum, and preferably less than half the length of the drum.

According to another aspect of the invention, the latter relates to a rolling screen device including a screen, a motorized load bar defining a reference axis and forming a drum for winding the screen around the reference axis, an end of the screen being attached to the load bar, the bar including two winding units, each winding unit including a gear motor housed in the load bar, having an output shaft secured to a pendulum, the pendulums being guided for rotating mechanically independently of each other around the reference axis, the motorized installation further including an electronic control circuit including means for synchronizing both winding units.

Moreover provision is made for being able to combine together the characteristics of the different described embodiments in order to form other variants.

SHORT DESCRIPTION OF THE FIGURES

Other features and advantages of the invention will become apparent upon reading the description which follows, with reference to the appended figures, wherein:

FIG. 1 illustrates a schematic view of a screen device provided with a motorized load bar according to a first embodiment of the invention;

FIG. 2 illustrates a schematic cross-sectional view of a detail of the device of FIG. 1;

FIG. 3 illustrates a schematic view of a screen device provided with a motorized load bar according to a second embodiment of the invention;

For more clarity, identical elements will be localized with identical reference signs on the whole of the figures.

DETAILED DESCRIPTION OF EMBODIMENTS

Figure 4:
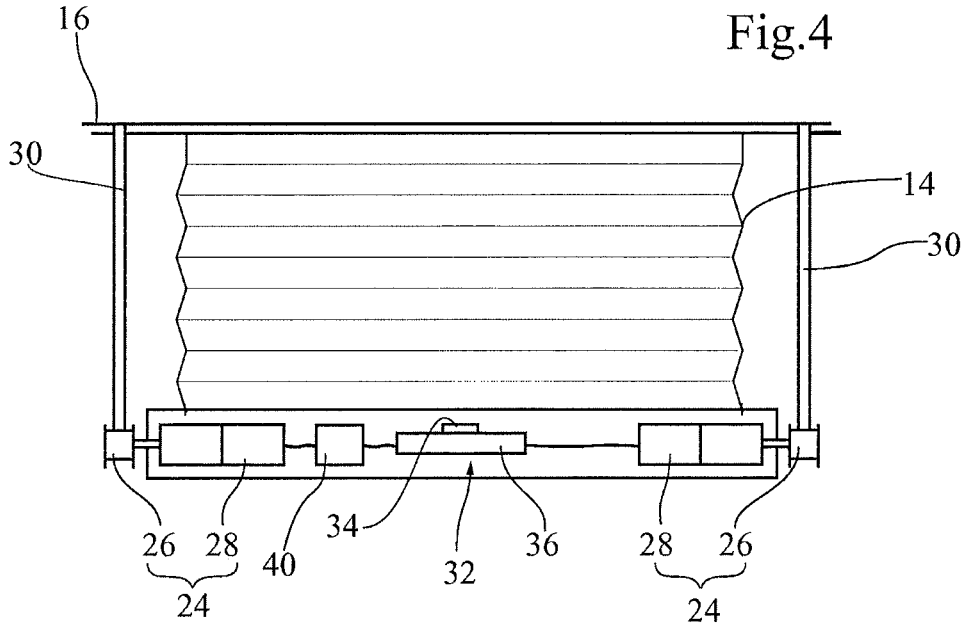
FIG. 4 illustrates a schematic view of a screen device provided with a motorized load bar according to a third embodiment of the invention.

In FIGS. 1 and 2, is illustrated a screen device 10, including a load bar 12 vertically mobile between a high position and a low position, and a cell or folded mobile screen 14, here an accordion-shaped screen, having a first end resting on the load bar 12 and a second end intended to be directly or indirectly attached to a dormant structure 16 of a building, for example a door or window frame.

The load bar 12 includes a box 18 defining a longitudinal reference axis 20 and two end housings 22, in which are housed two winding units 24. Each of the two winding units 24 includes a coil 26 associated with a driving gear motor 28. The coils 26 rotate around the longitudinal reference axis 20. Preferentially, the gear motors 28 are themselves not angular gear motors, therefore with members all rotating around axes parallel to the longitudinal reference axis 20. The coils 26 are not mechanically coupled with each other, so that they are free to rotate independently of each other.

With each winding unit 24 is associated a flexible connecting ribbon 30 including a first end attached to the winding coil and a second end directly or indirectly attached to the frame 16.

In the box of the load bar is further housed a control circuit 32 for the gear motors 28. An accelerometer 34 for example attached on a printed circuit board 36 of the control circuit, or directly on the box of the load bar 18, gives the possibility of detecting at each instant the horizontality of the longitudinal reference axis 20. The control circuit 32 also receives signals from sensors for example integrated to both gear motors 28 or to bearings for guiding the coils 26, giving the possibility of determining the angle of rotation and/or the speed of rotation of the driving axis and/or of the coils 26. The control circuit is also adapted for recovering and analyzing the information on the consumed current by each gear motor.

In this embodiment, electric wires 38 integrated to the screen 16 or to one of the ribbons 30, connect the control circuit 32 and the gear motors 28 to an electric power supply source of the building.

The control circuit 32 also includes an interface for communicating with a wired or wireless remote control (not shown). When an order for deploying or retracting the screen 14 is given, for example by a user acting on a tactile interface of the remote control, the control circuit 32 controls both gear motors 28 in the desired direction, while maintaining at each instant the horizontality of the longitudinal reference axis 20 of the load bar 12. This is achieved by the synchronization means adapted for controlling the angle of rotation and/or the speed of rotation of the output shafts of both gear motors and/or of the coils 26 in a synchronized way. Preferably, it is provided that the angle of rotation or the speed of rotation of one of the coils may be different from the angle of rotation or the speed of rotation of the other coil, but that this difference is selected so as to compensate for a shift in horizontality of the load bar. The electronic synchronization means allowing recovery of horizontality may be dynamic means (achieved during a displacement of the load bar) or static (the recovery takes place after stopping the displacement of the load bar). Depending on the deployment level of the screen 16, all or part of the screen is resting on an outer supporting face 39 of the box 18 of the load bar. The control unit may control the rotation of each gear motor according to information on position of each winding drum, or by providing the gear motors with independent set values of the position of rotation of each drum.

The load bar is weighted so as to have its center of gravity below the winding point of the ribbon, so that not only its longitudinal axis is horizontal, but the surfaces of the box also remain in a same plane. Any risk of swinging of the box forwards or rearwards is thereby avoided and, under this assumption, the risk of friction between the ribbons and the edges of the opening of the box through which the ribbons escape from the box is thus avoided.

In FIG. 3, is illustrate a second embodiment, different from the previous one by the method for supplying power to the control circuit 32 and the gear motors 28. Each of the winding units 24 is equipped with a battery 40 preferably positioned between the gear motor 28 and the longitudinal end of the load bar 12 the closest to the gear motor 28. This battery may be recharged by a panel of photovoltaic cells. Moreover, the screen 16 has been illustrated as a shutter with horizontal slats, which in the folded back position will be stacked on the load bar.

In FIG. 4 is illustrated a third embodiment, different from the previous ones by the positioning of the coils 26, which are positioned outside the box 18 of the load bar, in the axial extension of both longitudinal ends of the box 18 of the load bar. Moreover the screen has been illustrated as a folded screen. A single battery 40 powering both gear motors 28 and the control circuit 32 has also been illustrated.

Figure 5:
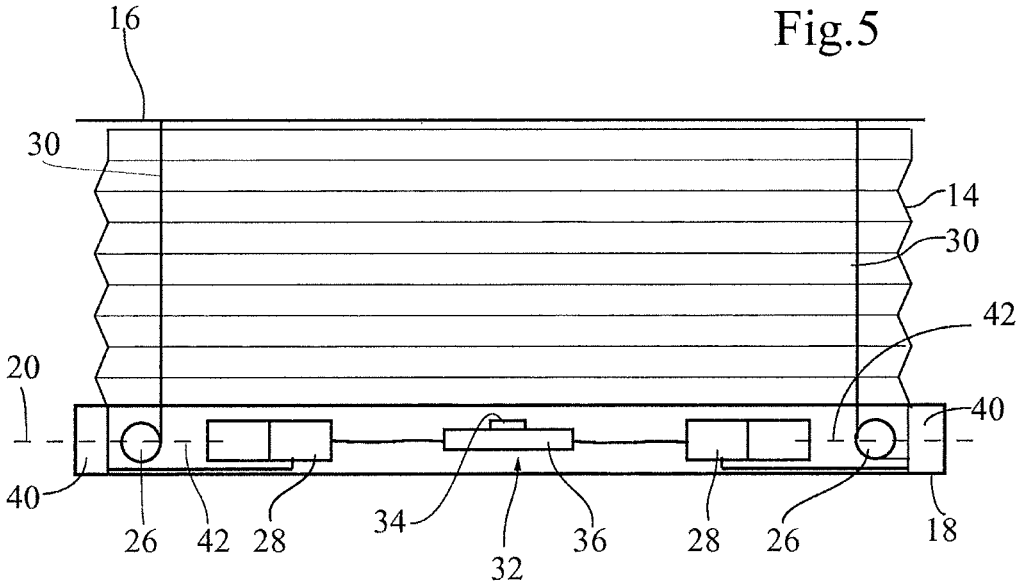
FIG. 5 illustrates a schematic view of a screen device provided with a motorized load bar according to a fourth embodiment of the invention.

In FIG. 5, is illustrated a fourth embodiment, different from the previous ones by the orientation of the coils 28, which each rotate around an axis perpendicular to the longitudinal reference axis 20 of the box 18 of the load bar and connected to the gear motor through an angular gearing 42.

Figure 6:
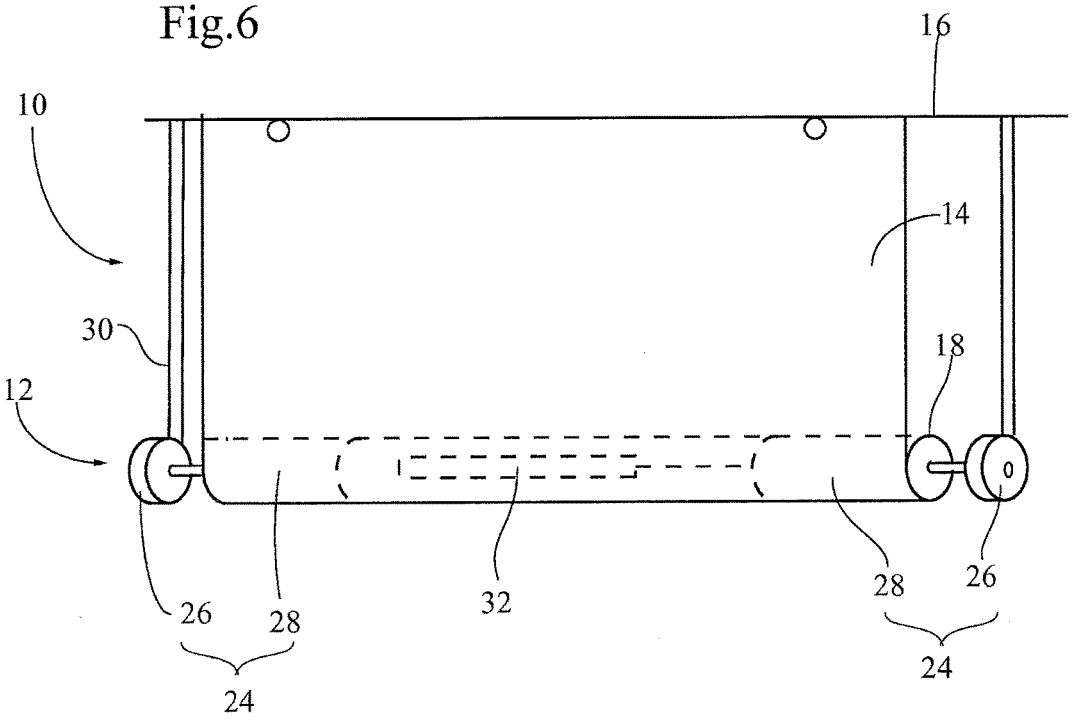
FIG. 6 illustrates a schematic view of a screen device provided with a motorized load bar according to a fifth embodiment of the invention.

In FIG. 6, is illustrated a fifth embodiment, different from the previous ones by the fact that the load bar is tubular, preferably cylindrical and forms a winding drum for the screen. More specifically, each gear motor, the case of which is secured to the load bar and the output shaft is secured to a coil, causes rotation of the coil and of the bar in opposite directions relatively to each other, so that the web is wound up on the bar while the ribbon is wound on the coil. The gear motor mounted in the bar then rotates in the direction opposite to the coil. The upward speed of motion is then reduced (ratio of the diameters) and the torque is increased in the same ratio. Coils with a small diameter will be preferred here in order to prefer the transmitted torque. In this embodiment, rebalancing of the horizontality of the load bar is possible, notably by the flexibility of the web.

Figure 7:
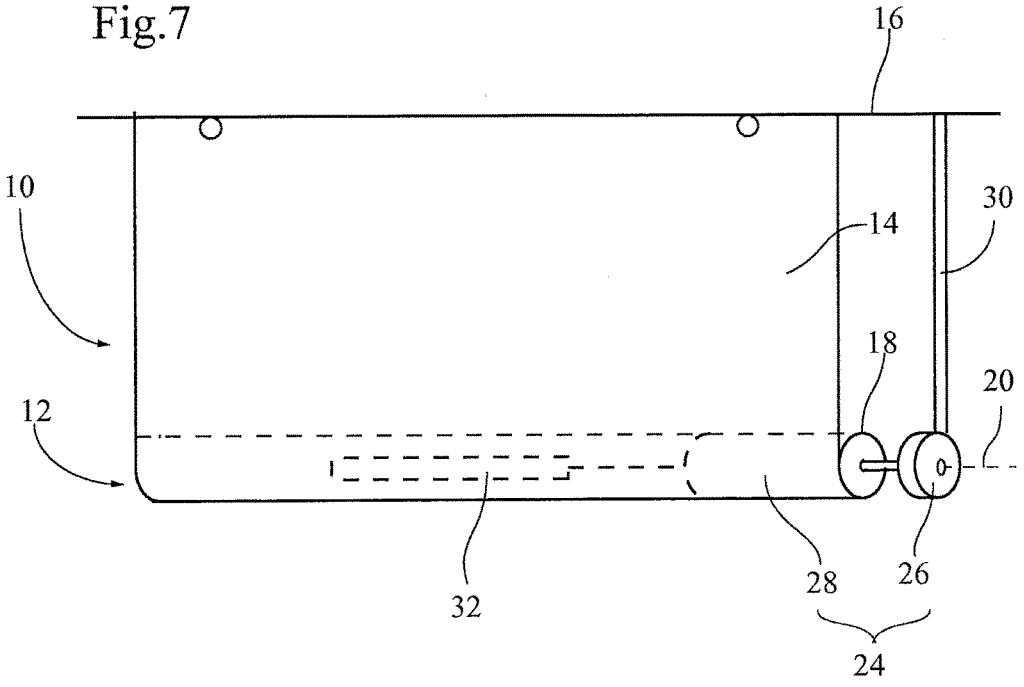
FIG. 7 illustrates a schematic view of a screen device provided with a motorized load bar according to a sixth embodiment of the invention.

It should be noted that this device is also applicable with a single driving unit, as illustrated in FIG. 7. The control unit 32 may then be simplified because of the automatic compensation which operates between the rotation of the coil 26 and that of the box 18, which maintains the latter horizontal. In particular, it is not necessary to equip the control unit with an accelerometer. Here, large diameter coils will advantageously be used for facilitating the balancing.

Figure 8:
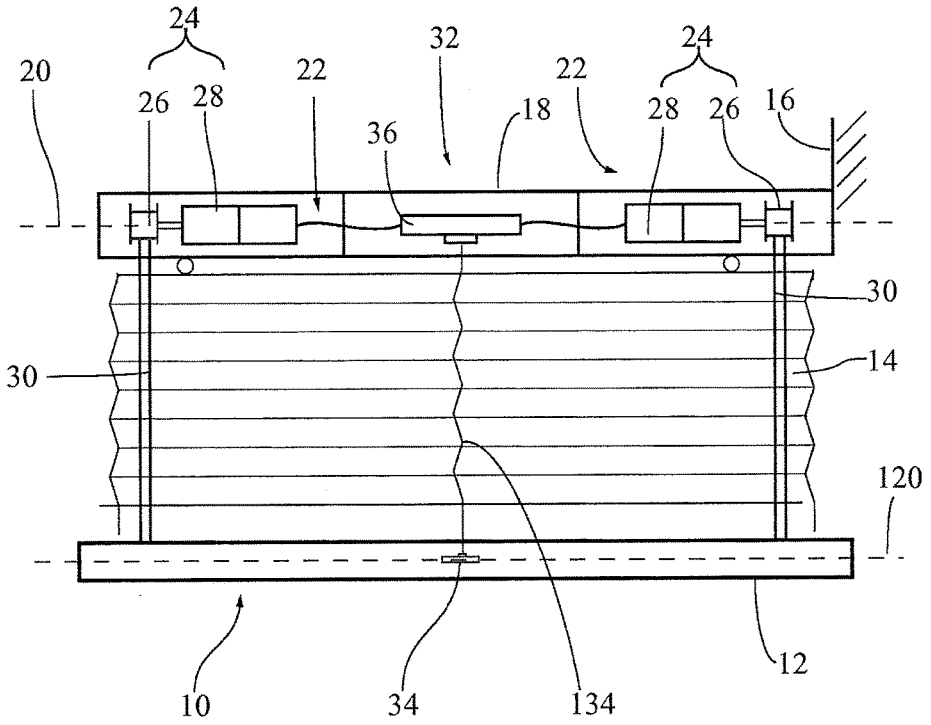
FIG. 8 illustrates a schematic view of a screen device provided with a motorized load bar according to a seventh embodiment of the invention.

In FIG. 8 is illustrated a screen device 10, including a load bar 12 vertically mobile between a high position and a low position, and an accordion-shaped screen 14, having a first end resting on the load bar 12 and a second end intended to be directly or indirectly attached to a dormant structure 16 of a building, for example a door or window frame.

A motorized installation for maneuvering the screen 14 is preferably housed in a box 18, itself attached to the dormant structure 16. The box 18 has two end housings 22, in which are housed two winding units 24. Each of the two winding units 24 includes a coil 26 associated with a driving gear motor 28. The coils 26 rotate around a longitudinal reference axis 20 of the box 18. Preferentially, the gear motors 28 are themselves without an angular member, therefore with rotating members all around axis parallel to the longitudinal reference axis 20. The coils 26 are not mechanically and rigidly coupled with each other, so that they are free to rotate independently of each other. With each winding unit 24 is associated a flexible connecting ribbon 30 including a first end attached to the winding coil and a second end directly or indirectly attached to the frame 16. In the box of the load bar is further housed a control circuit 32 for the gear motors 28.

The load bar 12 also defines a longitudinal reference axis 120. An accelerometer 34 attached to the load bar 12, gives the possibility of detecting at each instant, the horizontality of the reference longitudinal reference axis 120. The control circuit 32 is connected to the accelerometer 34 through an electric connection 134 or a wireless link. The accelerometer is then part of a detection unit, which may comprise its own energy source and a transmitter of signals passing over the electric link 134 or for example via radio waves. The control circuit also receives signals from sensors for example integrated to the two gear motors 28 or to the bearings for guiding the coils 26, giving the possibility of determining the angle of rotation and/or the speed of rotation of the driving axis and/or of the coils 26. The motorized maneuvering installation operates in the same way than in the previous embodiments.

Figure 9:
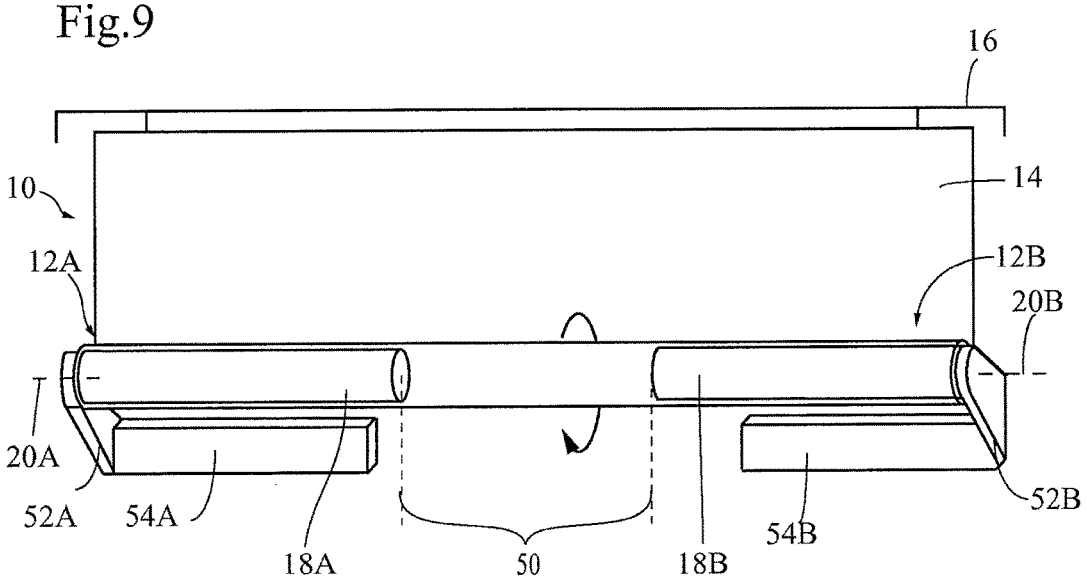
FIG. 9 illustrates a schematic view of a screen device provided with a motorized load bar according to a seventh embodiment of the invention.
Figure 10:
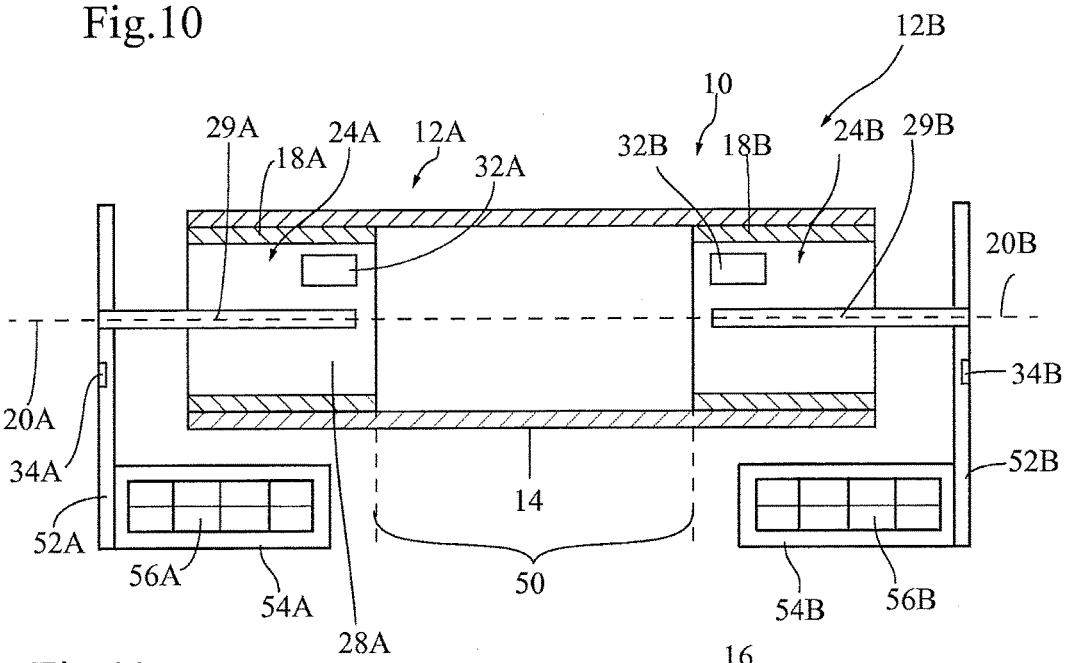
FIG. 10 illustrates another schematic view of the device of FIG. 9.

In FIGS. 9 and 10 is illustrated a screen device 10, the screen 14 of which is attached through an upper end directly or indirectly to a dormant structure 16 of the building, for example a door or window frame, and the lower end is intended to be partly wound on two load bars 12A, 12B, independent of each other and distant from one another and partly on itself in the intermediate area 50 between the load bars. This is notably possible when the web is rigidly maintained on the dormant structure 16. Each load bar 12A, 12B forms a winding unit 24A, 24B including a box 18A, 18B forming a drum and defining a longitudinal reference axis 20A, 20B and a housing in which is housed a driving gear motor 28A, 28B. The output shaft 29A, 29B of each gear motor 28A, 28B is bound through a radial arm 52A, 52B to a pendulum 54A, 54B located at a distance from the axis 20A, 20B for counter balancing the toque of the gear motor. Both drums 18A, 18B are not mechanically coupled with each other so that they are free to rotate independently of each other.

One of the two load bars is equipped with a master control circuit 32A, the other one with a slave control circuit 32B. Both control circuits are equipped with means for wireless communication between them. The master control circuit further includes an interface for communication with a remote wired or wireless remote control (not shown) and an interface for communication with a slave control circuit of the other control unit. When an order for deployment or retraction of the screen 14 is given, for example by a user acting on a tactile interface of the remote control, the master control circuit 32A controls the master gear motor 28A in the desired direction and imposes that the slave control circuit 32B follows this movement so that the angles of rotation of both gear motors 28A, 28B coincide. If necessary provision may be made for equipping the accelerometer arms 34A, 34B communicating with the master control circuit 32A and/or with the slave control circuit 32B, for example in order to correct the control of the slave gear motor according to an angular difference between both arms and to the angle of rotation of both driving shafts with respect to the drum. It is also possible to detect the horizontality of the axis of rotation of the gear motors or that of the pendulums. It is advantageously possible to position on the pendulums photovoltaic cells 56A, 56B for powering both gear motors 28A, 28B. Alternatively, it is possible to use optical means for checking the alignment of both pendulums relatively to each other. Alternatively, it is also possible to check the horizontality by measurements at the motor, for example by comparing current measurements of both gear motors.

Figure 11:
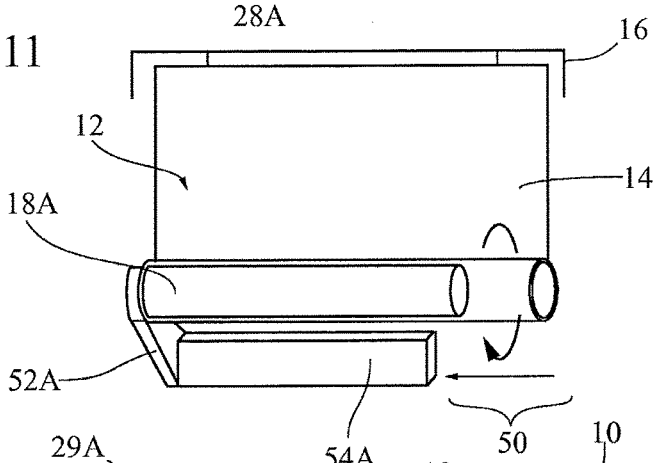
FIG. 11 illustrates a schematic view of an variant of the screen device of FIG. 9.

Incidentally it will be noted that the principle of winding a portion of a screen on itself rather than on a drum is also applicable to an installation with a single gear motor, as illustrated in FIG. 11. Under this assumption, a portion of the screen 50 is found in a cantilever position with respect to the drum 18 and winds onto itself.

Figure 12:
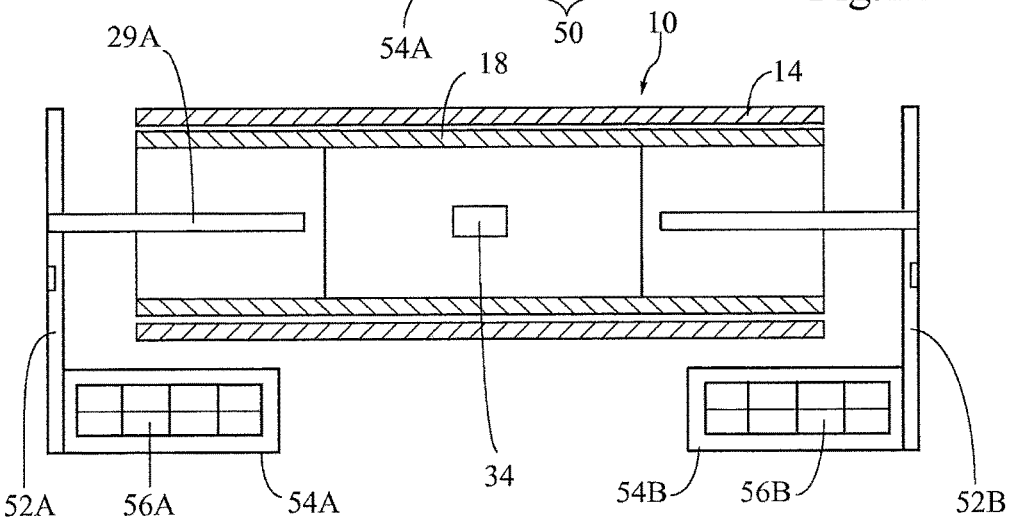
FIG. 12 illustrates a schematic view of another variant of the screen device of FIG. 9.

In FIG. 12, is illustrated a screen device 10, in another variant of the device of FIG. 10, the screen 14 of which is attached through an upper end directly or indirectly to a dormant structure of a building and the lower end is intended to be wound on a load bar 12 including a box 18 forming a drum and defining a longitudinal reference axis 20 and a housing in which are housed two driving gear motors 28A, 28B. The output shaft 29A, 29B of each gear motor 28A, 28B is connected through a radial arm 52A, 52B to a pendulum 54A, 54B located at a distance from the axis 20A, 20B for counter balancing the torque of the gear motor. Both pendulums 54A, 54B are not mechanically coupled with each other so that they are free to rotate independently of each other.

Each of the two gear motors is equipped with a control circuit 32A, 32B. Both control circuits are equipped with means for wired or wireless communication between them. At least one of the control circuits further includes an interface for communication with a wired or wireless distant remote control (not shown). The installation is equipped with accelerometers or inclinometers 34, 34A, 34B positioned on the box 18 of the load bar 12 and optionally on the arms 52A, 52B. These accelerometers are connected to at least one of the control circuit 32A, 32B. When an order for deployment or retraction of the screen 14 is given, for example by a user acting on a tactile interface of the remote control, the control circuit 32A, 32B are thus controlled depending on various signals so as to ensure the horizontality of the axis of rotation of the load bar 12. In this embodiment, rebalancing of the horizontality of the load bar is possible, notably by the flexibility of the web, or even by the torsional properties of the load bar. This configuration is actually advantageous in the case of shutters with a great length, for which the load bar is manufactured from lightened materials, more flexible than standard metal load bars.

Naturally, various other modifications may be contemplated. In particular, the communication or remote control interface described in connection with FIGS. 1 and 2, 9 and 10 or 12 is applicable to the different described embodiments. In particular, the remote control communicates with the control unit common to the two gear motors and a given movement order corresponds to the rotation of both gear motors in different directions (because of their mounting at opposite ends). First, the installation will have been configured, either because the motors are designed for being right-handed or left-handed motors, or by manual designation or automatic learning. In the latter case, these may for example be self-detection upon powering up, during controlled micro-movements.

The invention claimed is:

1. A motorized installation for maneuvering a screen having a first mobile end and a second opposite end, including;

at least two winding units positioned at the same one of the first or second end of the screen, wherein each of the two winding units includes a winding drum associated with a driving gear motor, the winding drums being guided so as to rotate mechanically independently of each other; and an electronic control circuit including means for synchronizing the two winding units wherein the control circuit controls each gear motor so as to ensure an horizontality of a reference axis of the first mobile end of the screen, and wherein the control circuit is connected to one or several sensor delivering a signal representative of the horizontality of the reference axis.

2. The motorized installation of claim 1, wherein the reference axis coincides with an axis of rotation of at least one of the winding drums or of one of the gear motors.

3. The motorized installation of claim 1, wherein the reference axis is a longitudinal axis of a load bar bound to the first mobile end of the screen or to a portion of the first mobile end of the screen.

4. The motorized installation of claim 1, wherein the control circuit is able to detect a rotation of each gear motor.

5. The motorized installation of claim 1, wherein each winding drum is a winding coil for a flexible connection independent of the screen, including a first end attached to the winding coil and a second end intended to be directly or indirectly attached to a dormant structure or to a load bar.

6. The motorized installation of claim 5, wherein the winding coils rotatable around a common longitudinal reference axis.

7. The motorized installation of claim 5, wherein the winding coils are rotatable around two parallel axes distant from each other.

8. The motorized installation of claim 1, further including a box defining two housings for the gear motors of the two winding units.

9. The motorized installation of claim 8, wherein the two winding units are positioned at two longitudinal ends inside the box of the installation.

10. The motorized installation of claim 8, further including at least one battery positioned between one of the gear motors and a longitudinal end of the box closest to said gear motor.

11. The motorized installation of claim 10, wherein the coils are positioned outside the box and in a longitudinal extension of the box.

12. The motorized installation of claim 8, wherein the box is a body of a load bar of the screen.

13. The motorized installation of claim 12, wherein the load bar has a center of gravity located below the common reference axis of rotation of the coils.

14. The motorized installation of claim 13, wherein the load bar is a winding drum for the screen.

15. The motorized installation of claim 1, wherein each drum is a winding drum for winding a portion of the screen.

16. The motorized installation of claim 15, wherein a median portion of the screen is not wound on any of the winding drums.

17. The motorized installation of claim 15, wherein each winding unit is bound to a different pendulum.

18. The motorized installation of claim 15, wherein the two winding units are bound to a common pendulum.

19. The motorized installation of claim 6 wherein the load bar has a center of gravity located below the common reference axis of rotation of the coils.

* * * * *